US012534924B2

(12) United States Patent
Dawson

(10) Patent No.: US 12,534,924 B2
(45) Date of Patent: Jan. 27, 2026

(54) WAVE SYSTEM AND METHOD

(71) Applicant: Whitewater West Industries Ltd., Richmond (CA)

(72) Inventor: Eliza R. Dawson, San Diego, CA (US)

(73) Assignee: WHITEWATER WEST INDUSTRIES LTD., Richmond (CA)

( * ) Notice: Subject to any disclaimer, the term of this patent is extended or adjusted under 35 U.S.C. 154(b) by 78 days.

(21) Appl. No.: 18/548,895

(22) PCT Filed: Mar. 3, 2022

(86) PCT No.: PCT/CA2022/000007
§ 371 (c)(1),
(2) Date: Sep. 2, 2023

(87) PCT Pub. No.: WO2022/183273
PCT Pub. Date: Sep. 9, 2022

(65) Prior Publication Data

US 2024/0151054 A1 May 9, 2024

Related U.S. Application Data

(60) Provisional application No. 63/156,303, filed on Mar. 3, 2021.

(51) Int. Cl.
*E04H 4/00* (2006.01)
*A63B 69/00* (2006.01)

(52) U.S. Cl.
CPC ..... *E04H 4/0006* (2013.01); *A63B 69/0093* (2013.01)

(58) Field of Classification Search
CPC ..... E04H 4/0006; A63B 69/0093
USPC ..... 4/488, 491, 541.1
See application file for complete search history.

(56) References Cited

U.S. PATENT DOCUMENTS 3,668,713 A 6/1972 Baker
5,401,117 A * 3/1995 Lochtefeld ..... A63B 69/0093 4/491
5,667,445 A * 9/1997 Lochtefeld ..... A63B 69/0093 472/117
5,738,590 A * 4/1998 Lochtefeld ..... A63G 31/007 472/117
6,019,547 A 2/2000 Hill
6,105,527 A * 8/2000 Lochtefeld ..... A63B 69/0093 114/274

(Continued)

FOREIGN PATENT DOCUMENTS

CA 3107865 A1 * 2/2020 ..... E04H 4/0006
GB 2591838 A * 8/2021 ..... E04H 4/0006

(Continued)

OTHER PUBLICATIONS

International Search Report and Written Opinion for International Application No. PCT/CA2022/000007, dated Jul. 28, 2022, 12 pages.

(Continued)

*Primary Examiner* — Lori L Baker
(74) *Attorney, Agent, or Firm* — Pillsbury Winthrop Shaw Pittman LLP

(57) ABSTRACT

A wave system is disclosed herein. The wave system may include an obstacle over which water is pushed to create a wave contoured surface for riding or maneuvering by a user.

13 Claims, 10 Drawing Sheets

(56) References Cited

U.S. PATENT DOCUMENTS

| | | | | |
|---|---|---|---|---|
| 6,629,803 | B1 | 10/2003 | McFarland | |
| 6,738,992 | B2 | 5/2004 | Lochtefeld | |
| 6,928,670 | B2 | 8/2005 | Lochtefeld et al. | |
| 6,932,541 | B2 | 8/2005 | McFarland | |
| 7,094,429 | B2 * | 8/2006 | Kiel | A61K 9/4858 514/855 |
| 7,326,001 | B2 | 2/2008 | McFarland | |
| 7,568,859 | B2 | 8/2009 | McFarland | |
| 7,653,433 | B2 * | 1/2010 | Lozano | A61P 25/00 607/3 |
| 7,658,571 | B2 | 2/2010 | McFarland | |
| 7,717,645 | B2 | 5/2010 | McLaughlin | |
| 7,722,291 | B2 | 5/2010 | McFarland | |
| 7,815,396 | B2 | 10/2010 | McFarland et al. | |
| 8,012,506 | B2 * | 9/2011 | Kiel | A61K 9/06 514/937 |
| 8,257,746 | B2 * | 9/2012 | Kiel | A61K 9/0056 514/937 |
| 8,303,213 | B2 * | 11/2012 | McFarland | A63G 31/007 405/79 |
| 8,496,403 | B2 | 7/2013 | Lochtefeld et al. | |
| 8,516,624 | B2 | 8/2013 | Klimaschewski | |
| 8,602,685 | B1 | 12/2013 | Mcfarland | |
| 9,144,727 | B2 | 9/2015 | Lochtefeld | |
| 9,777,494 | B2 | 10/2017 | Lochtefeld et al. | |
| 10,119,285 | B2 * | 11/2018 | Perslow | F04D 35/00 |
| 10,709,089 | B2 * | 7/2020 | Kraan | C12Q 1/6895 |
| 10,760,290 | B1 * | 9/2020 | Bennett | F04D 35/00 |
| RE49,215 | E * | 9/2022 | McFarland | E04H 4/0006 |
| 11,542,716 | B2 * | 1/2023 | Stockinger | E04H 4/0006 |
| 12,084,882 | B2 * | 9/2024 | Dawson | A63B 69/0093 |
| 2003/0180095 | A1 * | 9/2003 | McFarland | E04H 4/0006 405/79 |
| 2005/0207845 | A1 | 9/2005 | McFarland | |
| 2008/0089744 | A1 * | 4/2008 | McFarland | A63B 69/125 405/79 |
| 2009/0185863 | A1 * | 7/2009 | McFarland | A63G 31/007 405/79 |
| 2009/0264211 | A1 * | 10/2009 | Smythe | A63G 21/18 472/128 |
| 2011/0188937 | A1 * | 8/2011 | McFarland | E02B 3/02 405/79 |
| 2012/0020735 | A1 | 1/2012 | Fricano | |
| 2013/0322967 | A1 * | 12/2013 | McFarland | A63B 69/0093 405/79 |
| 2014/0105685 | A1 * | 4/2014 | McFarland | E04H 4/0006 4/491 |
| 2015/0057093 | A1 | 2/2015 | Murphy | |
| 2015/0089731 | A1 | 4/2015 | Lochtefeld | |
| 2016/0053504 | A1 | 2/2016 | Lochtefeld et al. | |
| 2018/0106058 | A1 * | 4/2018 | McFarland | A63B 69/0093 |
| 2018/0209159 | A1 * | 7/2018 | Perslow | E04H 4/0006 |
| 2018/0266129 | A9 | 9/2018 | McFarland | |
| 2019/0128002 | A1 * | 5/2019 | Perslow | E04H 4/0006 |
| 2019/0390472 | A1 * | 12/2019 | Spriggs | A63B 69/0093 |
| 2020/0284058 | A1 * | 9/2020 | Perslow | A63B 69/0093 |
| 2022/0259878 | A1 * | 8/2022 | Perslow | F04D 35/00 |
| 2022/0282508 | A1 | 9/2022 | Dawson | |
| 2023/0056207 | A1 * | 2/2023 | Bates | A63B 69/0093 |

FOREIGN PATENT DOCUMENTS

| | | | | |
|---|---|---|---|---|
| WO | WO-9204087 | A1 * | 3/1992 | A63B 69/0093 |
| WO | WO-9317762 | A1 * | 9/1993 | A63B 69/0093 |
| WO | WO-9639235 | A1 * | 12/1996 | A63G 3/02 |
| WO | WO-0108770 | A1 * | 2/2001 | E04H 4/0006 |
| WO | WO-03080962 | A2 * | 10/2003 | A63G 3/02 |
| WO | WO-03092460 | A1 * | 11/2003 | E04H 4/0006 |
| WO | WO-2004112894 | A1 * | 12/2004 | A61N 1/36096 |
| WO | WO-2008147508 | A1 * | 12/2008 | A63B 69/125 |
| WO | WO-2016041006 | A1 * | 3/2016 | E04H 4/0006 |
| WO | 2018083265 | A1 | 5/2018 | |
| WO | 2018149969 | A1 | 8/2018 | |
| WO | WO-2018188741 | A1 * | 10/2018 | A63B 69/0093 |
| WO | WO-2018206121 | A1 * | 11/2018 | E04H 4/0012 |
| WO | 2019018573 | A1 | 1/2019 | |
| WO | WO2022073095 | A1 | 4/2022 | |
| WO | 2022183273 | A1 | 9/2022 | |
| WO | WO-2023082027 | A1 * | 5/2023 | A63B 69/125 |

OTHER PUBLICATIONS

Non-Final Office Action for U.S. Appl. No. 17/653,433, dated Sep. 28, 2023, 12 pages.

Notice of Allowance for U.S. Appl. No. 17/653,433, dated Jan. 24, 2024, 09 pages.

Notice of Allowance for U.S. Appl. No. 17/653,433, dated May 8, 2024, 08 pages.

Patent Cooperation Treaty, International Search Report and Written Opinion issued in PCT/CA2021/000089, Dec. 30, 2021, pp. 1-11.

United States Patent and Trademark Office, Official Action issued in U.S. Appl. No. 18/248,049, Sep. 30, 2025, pp. 1-11.

United States Patent and Trademark Office, Official Action issued in U.S. Appl. No. 18/248,049, May 29, 2025, pp. 1-11.

United States Patent and Trademark Office, Official Action issued in U.S. Appl. No. 18/248,049, Nov. 20, 2024, pp. 1-8.

* cited by examiner

WAVE SYSTEM AND METHOD

CROSS-REFERENCE TO RELATED APPLICATIONS

This application claims the benefit of U.S. Provisional Patent Application Ser. No. 63/156,303 filed on Mar. 3, 2021, and International Patent Application PCT/CA2022/000007, filed Mar. 3, 2022, which are incorporated by reference in their entirety herein.

BACKGROUND

Water attractions have brought fun to different people from different geographic locations for many generations. The water attraction permits different geographic areas to have access to simulated experiences from other geographic areas. For example, a wave pool may approximate an experience at a beach.

Different water attractions may be used to approximate natural environments to permit users to experience sports and activities from these other environments. For example, sheet wave rides simulate a surfing or boogie boarding experience that permits a rider, with their body or a thin board, to ride upon a sheet flow of water that is contoured by an underlying ride surface. The sheet wave ride does not provide a true surfing experience, as the sheet flow does not permit wave breaking or the use of an actual surfboard.

Deep wave surfing systems provide that attempt to create a more accurate approximation of the surfing experience in the natural environment. Examples of wave systems may be found in, for example, U.S. Pat. Nos. 6,629,803; 6,738,992; 6,928,670; 6,932,541; 7,326,001; 7,568,859; 7,7,658,571; 7,717,645; 7,722,291; 7,815,396; 8,303,213; 8,496,403; 8,516,624; 9,144,727; 9,777,494; 10,119,285; United States Patent Publication Numbers 20150089731; 20160053504; 20180266129; and International Patent Application Publication Numbers WO2018083265; WO2018149969; WO2018188741; WO2019018573, all of which are incorporated by reference in their entirety herein.

SUMMARY

A wave system is disclosed herein. The wave system may include an obstacle in which water is pushed over to create a wave contoured surface for riding or maneuvering by a user.

The exemplary wave system may include an adjustable obstacle for changing the wave contoured surface of the water flowing over the obstacle. Exemplary embodiments may include a controller for adjusting the obstacle for desired configurations.

The exemplary wave system may include a declined surface extending from the water outlet toward the obstacle. The declined surface may be bounded by interior side walls. The interior side walls may be tapered, narrowing from a wider end near the water outlet to a narrower end adjacent the object. Exemplary embodiments may include different combinations of tapered and/or non-tapered interior side walls.

The exemplary wave system may include a water cycle in which water leaves the water outlet, over the obstacle, through a water drainage system, through a reservoir under the water ride area, and back to the water outlet. In an exemplary embodiment, the wave system may include a pump system in the reservoir under the ride area. The pump system may be positioned at or rearward of the obstacle and toward a rear of the wave system. The pump system may include a moveable mechanism for translating the pumps from a first position to a second position. The pump system moveable mechanism may be used to access the pumps for installation, maintenance, and/or replacement. Exemplary embodiments of the pump system may include pump inlets that are positioned toward a lower portion of the reservoir for drawing water into the pump from a bottom of the reservoir away from the water surface.

The exemplary wave system may include a water smoothener. Exemplary embodiments of the wave smoothener may be created by sheets having apertures therein. The sheets may be positioned in direct contact or may be positioned with gaps between adjacent sheets.

DRAWINGS

DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments described herein include a wave generation system and methods for generating a rideable wave.

Although embodiments of the invention may be described and illustrated herein in terms of a rideable wave, it should be understood that embodiments of this invention are not limited to any specific or required wave size and/or shape. As disclosed herein, exemplary embodiments may create different water surfaces, configurations, and experiences, all of which are within the scope of the instant disclosure. In addition, different features and combinations of structures, configurations, shapes, and components are provided as exemplary only. No feature, objective, or result is necessary to the invention, and therefore, no corresponding structure, component, or configuration is required or necessary to the invention. Instead, any combination of features, components, and configurations may be used in any combination and remain within the scope of the instant description.

Figure 1:
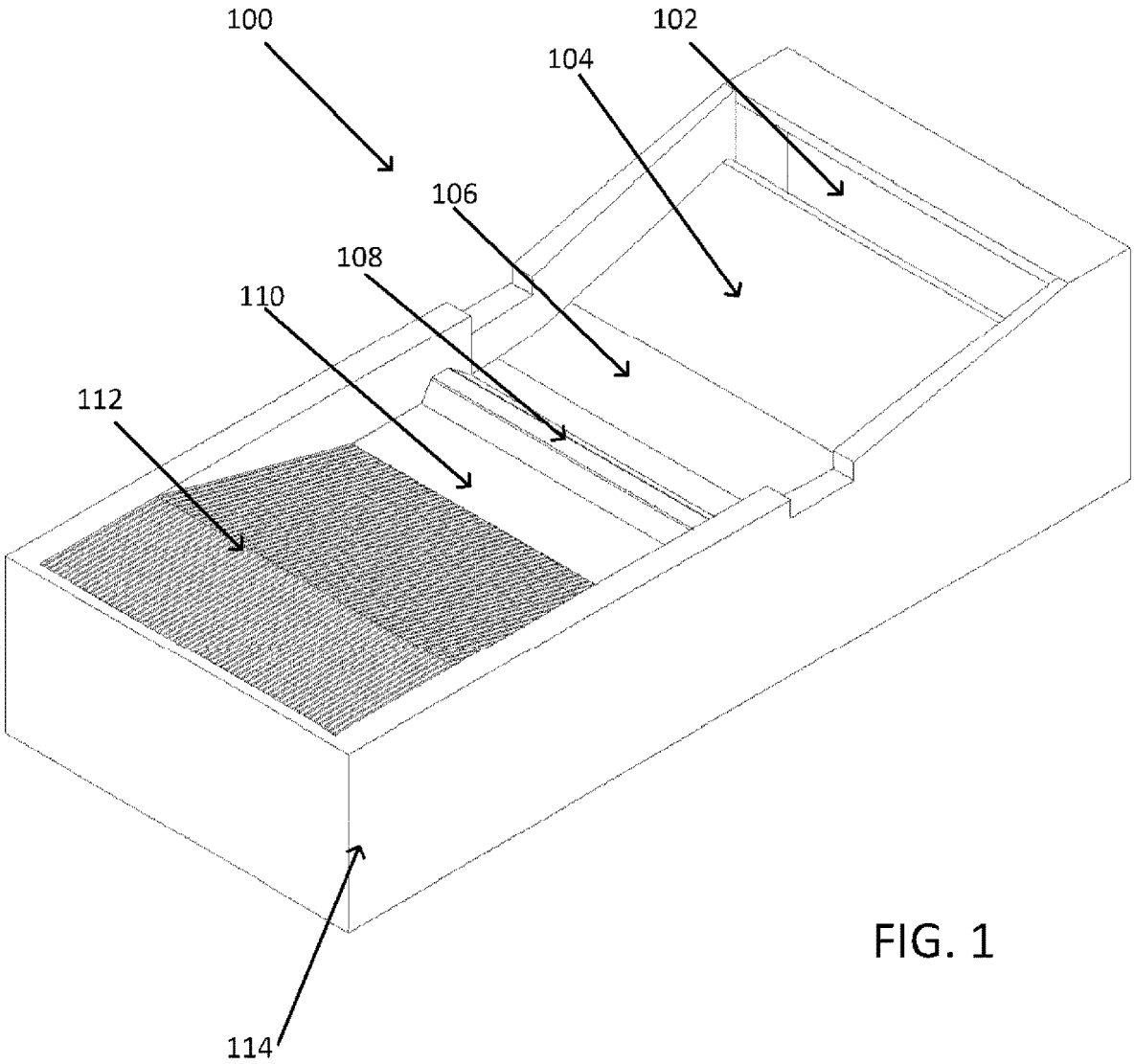
FIG. 1 illustrates a perspective view of an exemplary wave system according to embodiments described herein.

FIG. 1 illustrates an exemplary wave system according to embodiments described herein. The exemplary wave system 100 may include a water outlet 102 for introducing water onto a rideable area of the ride. The wave system 100 may include an obstacle 108. Water introduced onto the ride from the water outlet 102 may encounter the obstacle 108 to generate a contoured wave surface with the water. The contoured wave surface of the water (not shown) may be used as a rideable wave. The wave system 100 may include a water drainage system 112 to remove the water from the ride area and/or permit rider exit. The wave system 100 may also include a containment structure 114 for holding and containing the water and wave system components.

As seen in FIG. 1, the obstacle 108 is positioned between the front of the wave system 100 where water is introduced at the water outlet 102 and the back of the wave system where water is removed at the water drainage system 112. As illustrated, the obstacle 108 may be connected or positioned relative to or integrated into the ride structure such that it forms a generally convex shape above a horizontal plane of a floor surface of the ride area. The obstacle 108 therefore defines a local maximum elevated surface relative to portions of the floor surface adjacent to the obstacle 108. The obstacle is configured to cause the water flowing thereover to back up creating a desired contoured wave surface for riding by a user.

Figure 8A:
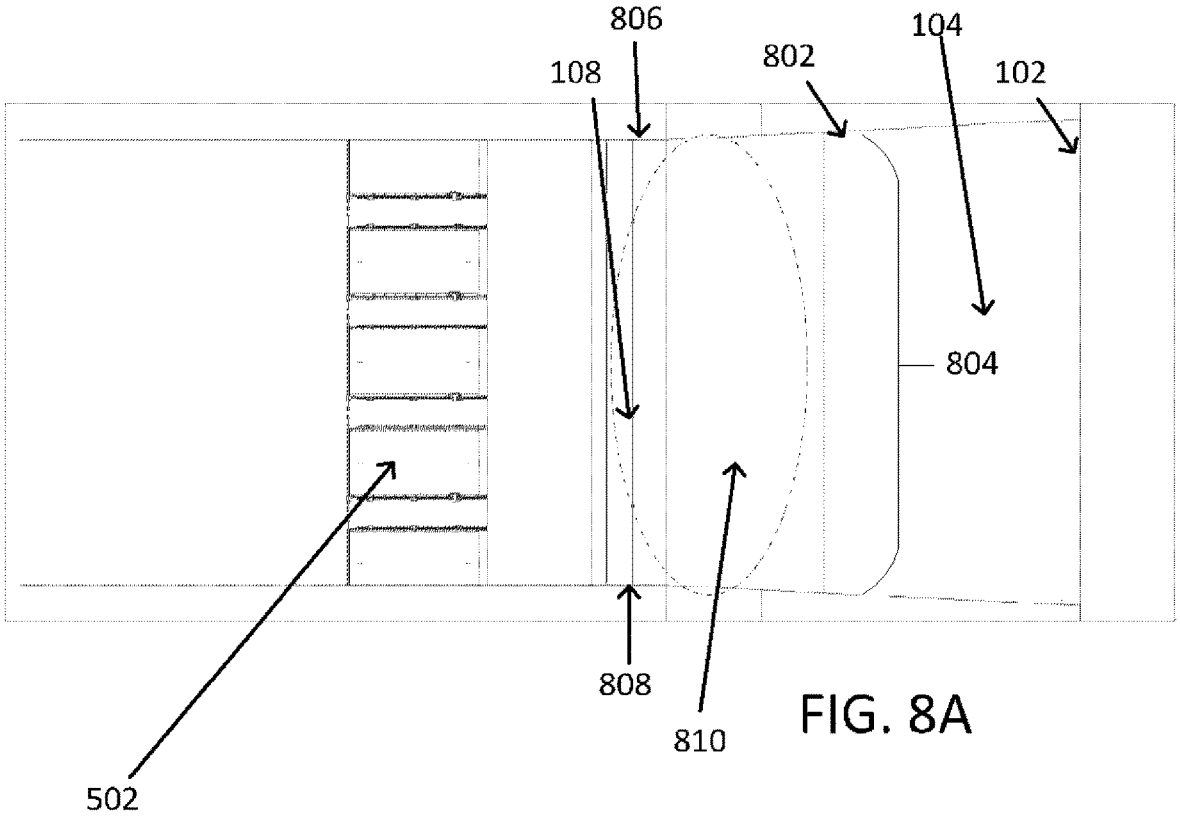
FIGS. 8A-8B illustrate top elevation views with components removed for visualization of components in a first and second position according to embodiments described herein.
Figure 8B:
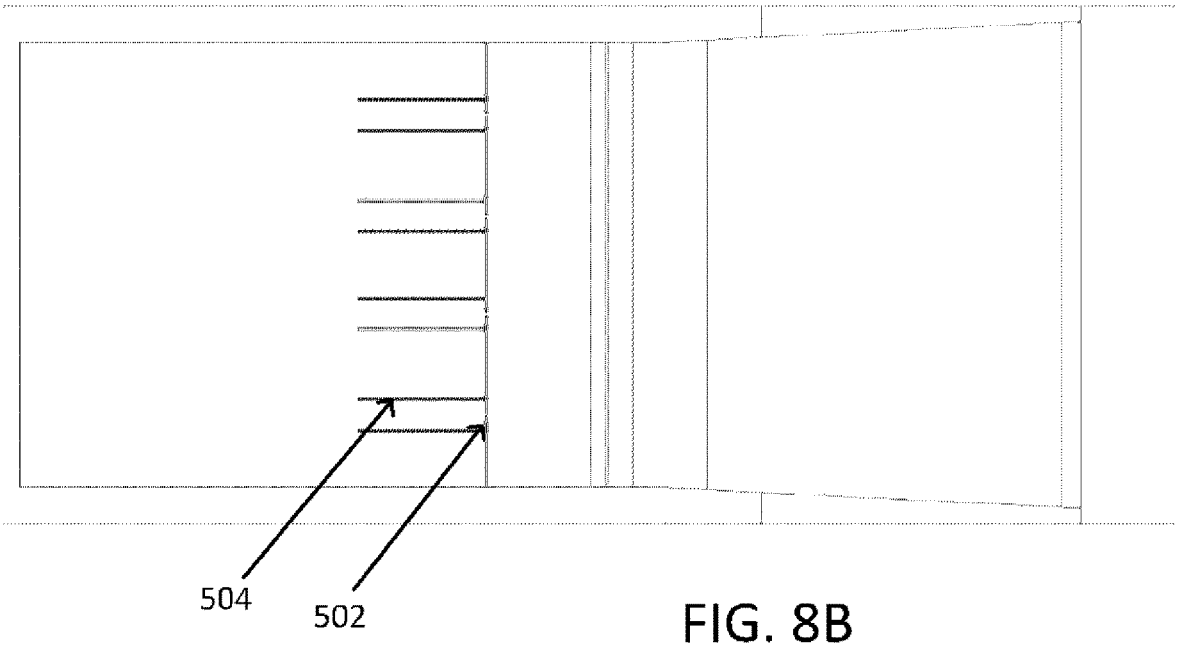

As seen in FIG. 1 and FIGS. 8A-8B, the obstacle 108 may extend transversely across at least a portion of the ride structure from one lateral side 806 to an opposing lateral side 808 of the rideable area 810. The rideable area 810 may be the over the top of the ride structure over the obstacle, toward the water outlet 102 from the obstacle, and in the area adjacent the obstacle in which the contoured wave surface is created with the water flowing thereover. The obstacle 108 may have a constant or variable cross sectional profile as the obstacle is traversed laterally across the rideable area. For example, as illustrated in FIG. 1, the obstacle 108 defines an elevated surface that is the same across the ride area. Other configurations of the obstacle may also be used. For example, the obstacle may be separate segments that may be positioned adjacent one another across the rideable area. In an exemplary embodiment, more than one obstacle may be used, which may be positioned at different locations laterally (side to side) and/or longitudinally (front to back) on the rideable area. As another example, the obstacle may include a variable cross sectional profile as the obstacle is traversed laterally across the rideable area. For example, the obstacle may include a curvature in a horizontal plane, such that one portion of the obstacle may be positioned in front of or behind another portion of the obstacle relative to the water outlet 102. As described herein in more detail, exemplary embodiments may include the dynamic changing of the obstacle 108 shape, and/or obstacle location on the ride area.

Figure 2:
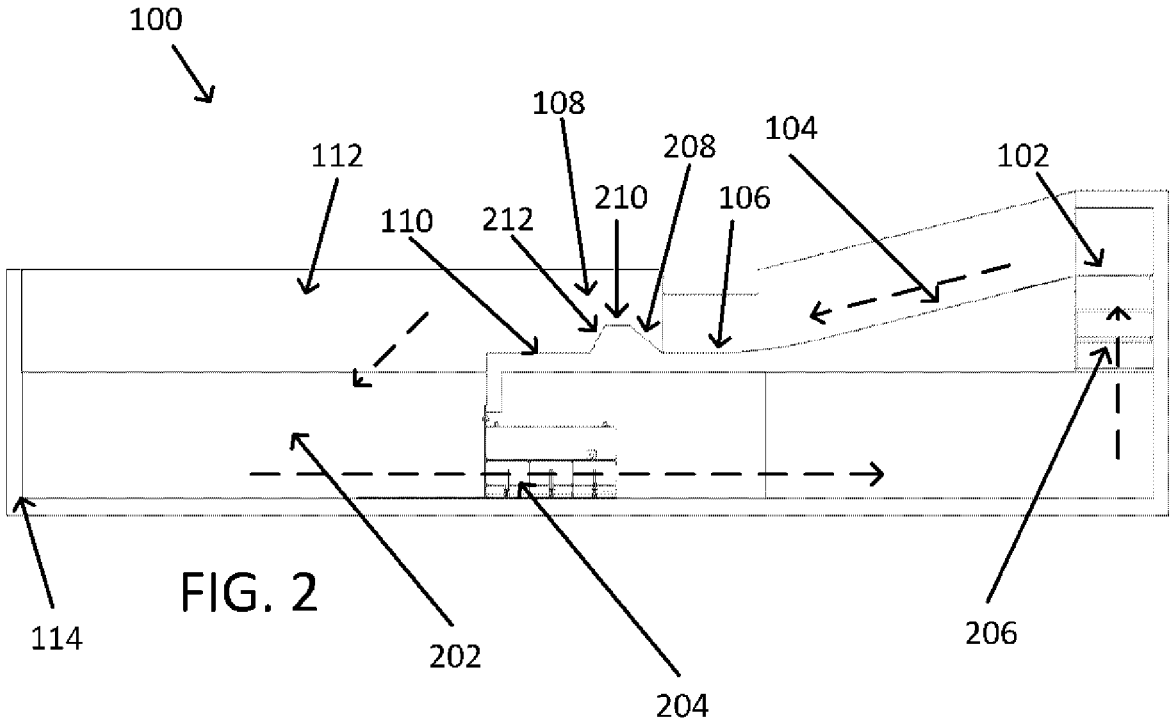
FIG. 2 illustrates a cross sectional view of an exemplary wave system according to embodiments described herein.

As more easily observed in FIG. 2, the obstacle can include one or more shaped surfaces. As illustrated, the obstacle may include a front surface 208, a transition surface 210, a rear surface 212, and any combination thereof. The front surface 208 may be an upwardly sloped surface above the ride floor, such as at transition surface 106 and/or 110. As illustrated in FIG. 2, each of the front surface 208, transition surface 210, and rear surface 212 are planar. However, each surface may also be concave curved, convex curved, compound curved, or combinations thereof. As illustrated, each of the front surface 208, transition surface 210, and rear surface 212 are stepwise coupled creating a discontinuous surface encountered by the water as it flows over the obstacle 108. Exemplary embodiments may include curvatures on portions of and/or between the respective surface(s), transition segments, integration between segments, or contouring surfaces and/or layers across one or more segments to reduce the discontinuity and/or create a continuous surface from the front of the obstacle to the top of the obstacle or to the back of the obstacle.

In an exemplary embodiment, the wave system 100 may include a declined surface 104. The declined surface 104 may be positioned adjacent the water outlet 102. Exemplary embodiments may have the water outlet 102 at a higher elevation and the declined surface 104 is configured to move the water to a lower elevation before encountering the obstacle 108. The declined surface 104 may be configured to increase the velocity of the water encountering the obstacle. The declined surface 104 may be used to create a trough between the declined surface 104 and the obstacle 108 to influence the shape of the contoured wave surface created by the water. The wave system 100 may also include a transition surface between the declined surface 104 and the obstacle 108. The transition surface 106 may define a minimum elevation of a ride surface. The transition surface 106 may be planar and horizontally level. The transition surface 106 may be contoured to transition the flow of water from the declined surface toward the obstacle.

As best illustrated by the top elevation view of the wave system and declined surface 104 of FIG. 8A, the declined surface may have opposing interior walls 802. The interior walls 802 may contain the flowing water from the water outlet and down the declined surface 104. As illustrated, the opposing interior walls may be inwardly tapered from a first end toward the water outlet 102 toward a second end toward the obstacle 108. A cross-wise, lateral distance between opposing interior walls 802 defines an interior diameter 804 of the declined surface 104. As illustrated, the diameter 804 of the declines surface 104 is greater proximate the water outlet 104 and lesser proximate the obstacle 108. The taper may extend from adjacent the water outlet 102 near the obstacle 108, to a beginning edge of the obstacle 108, near the maximum elevated portion of the obstacle, or after the obstacle. In an exemplary embodiment, the tapering of the opposing interior walls 802 may be used to reduce sidewall effects on the water as the water flows down the declined surface 104. For example, the frictional effects of the sidewall may cause turbulence and white-water to occur near the interior walls of the ride. The tapering may be used to increase the speed of the water and minimize the sidewall effects. The tapered sidewalls may therefore be used to reduce the appearance of turbulence in the flowing water to create a smoother, glassier water surface. The interior walls 802 may be tapered along an entire length of the declined surface or any portion thereof. For example, the interior walls 802 may include a parallel or non-tapered portion adjacent the water outlet, but a tapered portion toward the obstacle end of the declined surface. In an exemplary embodiment, the walls may interior walls 802 may also be inwardly or outwardly tapered as the interior wall is traversed upward in elevation above the ride surface. For example, the interior walls 802 may be angled inwardly or outwardly from the vertical plane.

Referring back to FIG. 1, the wave system may include a water drainage system 112. As illustrated, the water drainage system 112 (or water recovery) may be positioned on an opposite side of the obstacle 108 than the water outlet 102. The water drainage system 112 may remove the water from the ride surface. In an exemplary embodiment, the water drainage system 112 may recycle the water back to the water outlet 102. For example, the water drainage 112 may include a portion of the ride surface having apertures or passages there through for permitting the passage of water from the ride surface to an area below the ride surface. Other drainage systems may be used, such as drainage surface on the lateral sides and/or the tops of the lateral sides of the sidewalls of the ride structure. Any combination of drainage features may be used in any combination. As illustrated, the wave system 100 may include a transition surface 110 between the obstacle 108 and the drainage system 112.

As illustrated, the water drainage system 112 may include an inclined surface. The inclined surface may be configured such that a user may exit the ride area by walking on the inclined surface out of the water. The inclined surface may therefore be textured, contoured, shaped, or through the apertures create an increased frictional surface for easier standing and walking by the user. The drainage system 112 may also include an extended rear section. This area may be used to slow a rider, permit spectator viewing, permit operator positioning and/or availability for assistance of users, and combinations thereof. As the water drainage system may be impacted by the user after rider the contoured wave surface of the water generated by the obstacle, the water drainage system may be padded or have other impact resistant features. In an exemplary embodiment, the water drainage system may have a flexible covering and/or surface.

As illustrated in FIG. 1, the wave system 100 may include a containment structure 114. The containment structure 114 may contain the water within system. The containment structure may provide structural support for one or more components of the wave system 100. In an exemplary embodiment, the containment structure is sufficiently strong to retain and the amounts of water for the ride operation. In an exemplary embodiment, the containment structure 114 is configured to retain water below the ride area. The containment structure may therefore define a reservoir for passing water received from the drainage system 112 under the ride area back to the water outlet 102. As described more fully herein, the reservoir below the ride area may include one or more pumps for moving water as described herein. In an exemplary embodiment, the containment structures is concrete. In an exemplary embodiment portions or all of the ride surface may be concrete. For example, the declined surface 104 may include a concrete under layer for support the flowing water from the water outlet 102. The containment structure, and/or portions of the wave system may include one or more access panels and/or doors to allow access to components and/or locations within the wave system structure.

Figure 3:
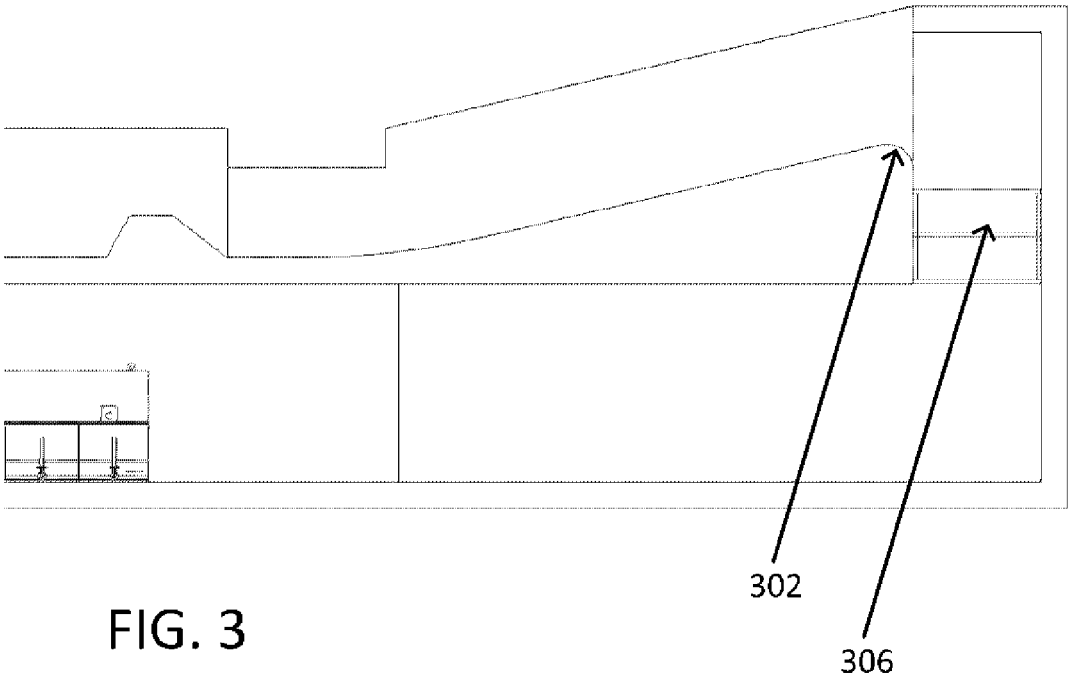
FIG. 3 illustrates a partial cross sectional view of an exemplary wave system according to embodiments described herein.

FIGS. 2-3 illustrate cross sectional views of an exemplary wave system according to embodiments described herein. As illustrated by the dashed lines of FIG. 2, the water may be circulated from the water outlet 102, down the declined surface 104 to encounter the obstacle 108 and create the contoured wave surface with the water, to drain through the drainage system 112 to be moved through the reservoir 202 by nozzles 204.

Exemplary embodiments may also include water filters. Water filters may be used to reduce debris in the system that may clog the nozzles and/or create obstacles for riders while they are within the ride area. In an exemplary embodiment, the water drainage system 112 may provide a first filter. As described herein, the water drainage system 112 may include a porous to permit water to pass there through. The water drainage system 112 may be configured to filter out materials larger than a desired size. For example, the water drainage system 112 may be used to keep a person, body parts, clothing, shoes, boards, riding vehicles, bracelets, watches, phones, cameras, wallets, and other objects that may be lost by a user while riding the wave system. One or more filters may also be positioned on an inlet and/or outlet side of the nozzle 204. One or more filters may also be positioned before or proximate to the water outlet 102. The filters may be removable and/or replaceable for maintenance and/or easy cleaning. The filters at the nozzles may be supported by the nozzles for access according to embodiments described herein.

Exemplary embodiments may also include one or more water smoothener 206, 306. The water smoothener 206, 306 may be positioned adjacent a water outlet 102. The water smoothener may be configured to reduce turbulence in the water flow. Exemplary water smoothener may include a system of apertures or passing the water. For example, a smoothener may include a planar structure including a plurality of apertures therein. The smoothener may include a mesh, expanded metal, net, or other configuration. Exemplary embodiments of a smoothener is described in more detail herein in reference to FIG. 9.

As described herein, the water smootheners and/or position of the pumps may be used to reduce turbidity of the water coming from the water outlet. For example, as the water travels from the pumps, the water turbidity may be reduced. Therefore, the further the pumps are from the water outlet, the less turbidity there may be in the water outlet. However, the further the pumps are from the water outlet, the more power is required to push the water through the system. The smootheners may also be used to reduce turbidity in the water. However, the more smootheners that are present or the more interference to the cross sectional area of the water passage, the more power is required to push the water through the smootheners.

As shown and described herein, the wave system 100 may include one or more surfaces for supporting, containing, and/or moving water. The surfaces illustrated herein are generally planar surfaces creating discontinuity between one surface area to an adjacent surface area. The invention is not so limited. Instead, surfaces may include fillets or other tapered, curved, or transitional area to reduce the discontinuity between surfaces, and/or create a continuous transition from one surface to an adjacent surface. The transition may be accomplished through contouring of either or both of the adjacent surfaces. The transition between surfaces may be through one or more layers or coatings between adjacent surfaces. For example, as seen in FIG. 3, a fillet 302 may be used at a surface transition between the reservoir and the water outlet. The fillet 302 may be a curved surface to create a continuous transition between an upwardly extending wall from the reservoir to the downwardly inclined declining surface to the ride area.

The surfaces shown and described herein may include additional features, such as surface coatings, drainage features, additional layers, and combinations thereof. The additional features may be to reduce the effects of impact by a user or reduce injury during the ride experience through contact with the surface. The additional feature may include foam or other padding. The additional features may be to reduce the impacts of the environment on the wave system or system components. For example, additional features may include UV resistant, water resistant, chlorine resistant, etc. protections and/or coatings. Additional features may include sealants to reduce water penetration into parts of the system. Additional features may include frictional engagement or frictional reducing structures, coatings, and/or layers. Exemplary portions of the system may benefit from reduced friction, such as at or along the declined surface 104, while portions of the system may benefit from increased friction, such as at or along the drainage system 112. Any combination of additional features may be used with any features described herein.

Figure 4A:
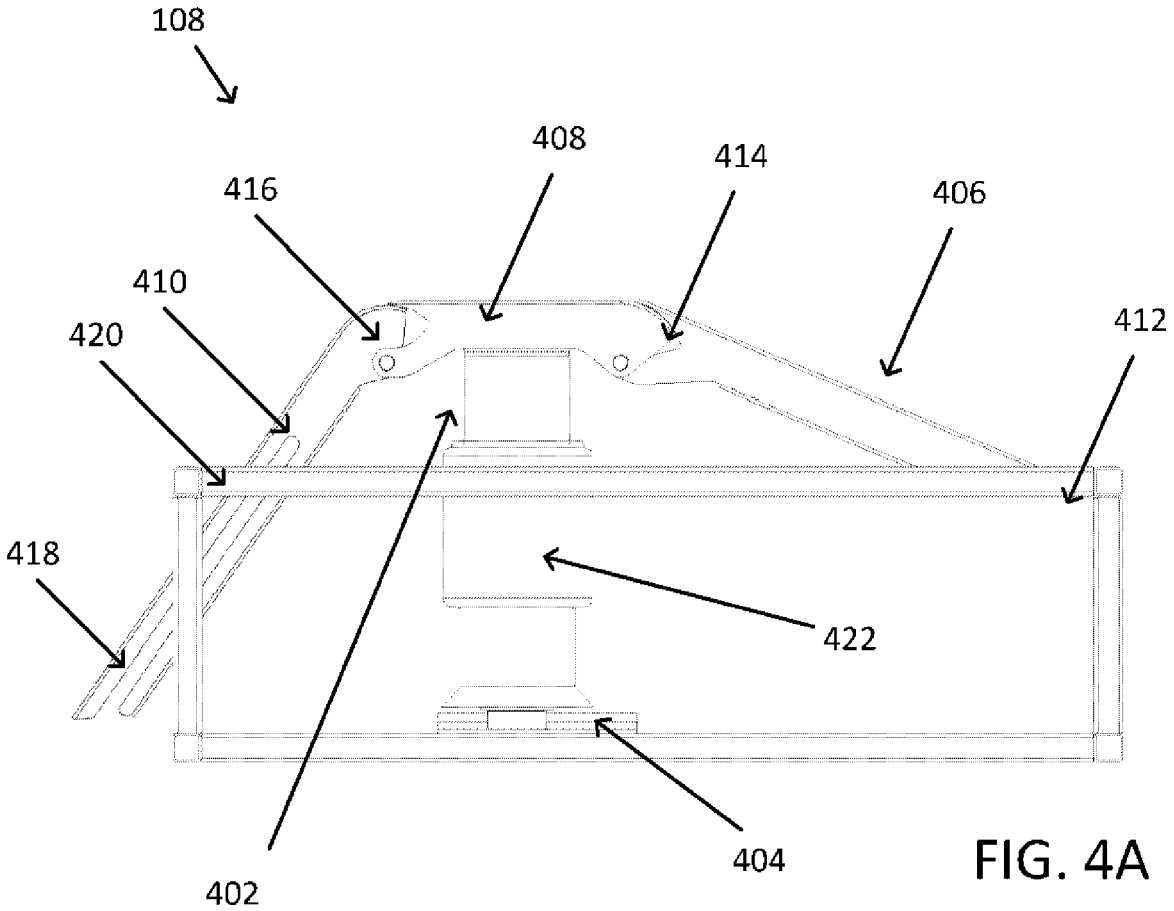
FIGS. 4A-4B illustrate a partial cross sectional view of components of an exemplary wave system according to embodiments described herein.
Figure 4B:
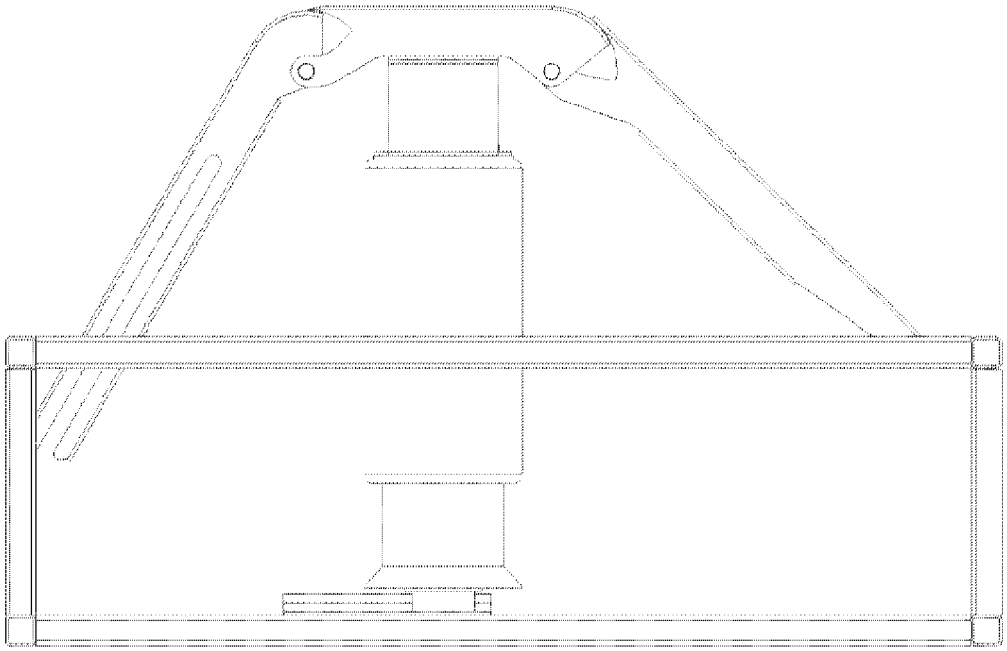

FIGS. 4A-4B illustrate an exemplary component view of an exemplary embodiment of an obstacle according to embodiments described herein. In an exemplary embodiment, the obstacle 108 is deformable such that the obstacle may present a different cross sectional front profile to oncoming water. The size of the obstacle front profile may be used to vary or change the contoured wave surface created with the water flowing over the obstacle 108. FIG. 4A illustrates an exemplary obstacle 108 having a reduced front profile size, while FIG. 4B illustrates an exemplary obstacle having an enlarged front profile size. The front profile size may include a height dimension relative to the ride surface. The height dimension may be changed to change the front profile size.

As illustrated, the obstacle may include a front surface 406, a transition surface 408, a rear surface 410, and any combination thereof. As illustrated, the front surface 406 may be pivotably coupled to the ride infrastructure. As illustrated a pivot connection 412 may be used to couple the front surface 406 to the ride surface 420. The front surface 406 may be pivotably coupled through a joint 414 to transition surface 408. The transition surface 408 may be pivotably coupled through a joint 416 to the rear surface 410. The illustrated joints 412, 414, and 416 may be pin joints, but other joints may also be used. For example, flexible materials, such as a covering or extension of one surface to an adjacent surface may be used. As illustrated, the rear surface 410 may be configured to slide through the support infrastructure, such as ride surface 420. The rear surface 410 may extends through the ride area surface to permit adjustment of the inclined portion and maintain a continuous surface across the obstacle from the front to the back of the obstacle. The rear surface 410 may include a slot 418 to accept a rod or portion of the ride infrastructure to support the rear surface 410 in a desired position relative to the ride surface. The slot within the rear surface may slide along and/or rotate about the rod.

In an exemplary embodiment, the obstacle 108 may be coupled to an actuator 422. The actuator may have two degrees of freedom. As illustrated, the actuator may extend or translate along a first axis. The actuator may translate or slide along a second axis. The first axis may be perpendicular to the second axis. For example, as illustrated, an air spring 402 may provide an extendable/retractable shaft along a first axis, while a slide bearing 404 may be used to provide slidable translation along a second axis. As illustrated, the air spring is mounted on the slide bearing. The end of the extendable/retractable shaft of the air spring may be coupled to any of the surfaces of the obstacle. As illustrated, the air spring is coupled to the transition surface 408. As seen from the comparison between FIGS. 4A and 4B, as the shaft of the air spring 402 extends upward, the transition surface 408 is elevated. Through the joint 414 between the transition surface 408 and the front surface 406, the front surface is rotated about pivot 412 so that an end of the front surface 406 is elevated with the transition surface 408. As the front surface 406 rotates, the transition surface 408 and air spring 402 translate along the sliding bearing toward the front of the obstacle (toward the water outlet 102 not shown). As the transition surface 408 elevates, the rear surface 410 also rotates about joint 416 and the slot 418 of the rear surface 410 slides along shaft or structure support portion.

Exemplary embodiments may also include the adjustment of the obstacle 108 in other fashions and directions. For example, the entirety of the obstacle may be repositioned, such as in moving forward, backward, laterally from side to side, and/or in rotation about a vertical axis, such that an angle is introduced so that one end of the obstacle may be moved closer or further away from the water outlet than the opposing end. Exemplary embodiments may include any combination of actuators and/or controllers, bearings, sliders, inflatable, rails, pivots, hinges, springs, drives, shafts, rollers, or other mechanical/electrical system for positioning and/or deforming the obstacle.

Although exemplary embodiments described herein include an air spring on a sliding bearing, other actuators are within the scope of the instant disclosure. For example, an inflatable bladder may be used to elevate the transition surface 408.

Figure 10:
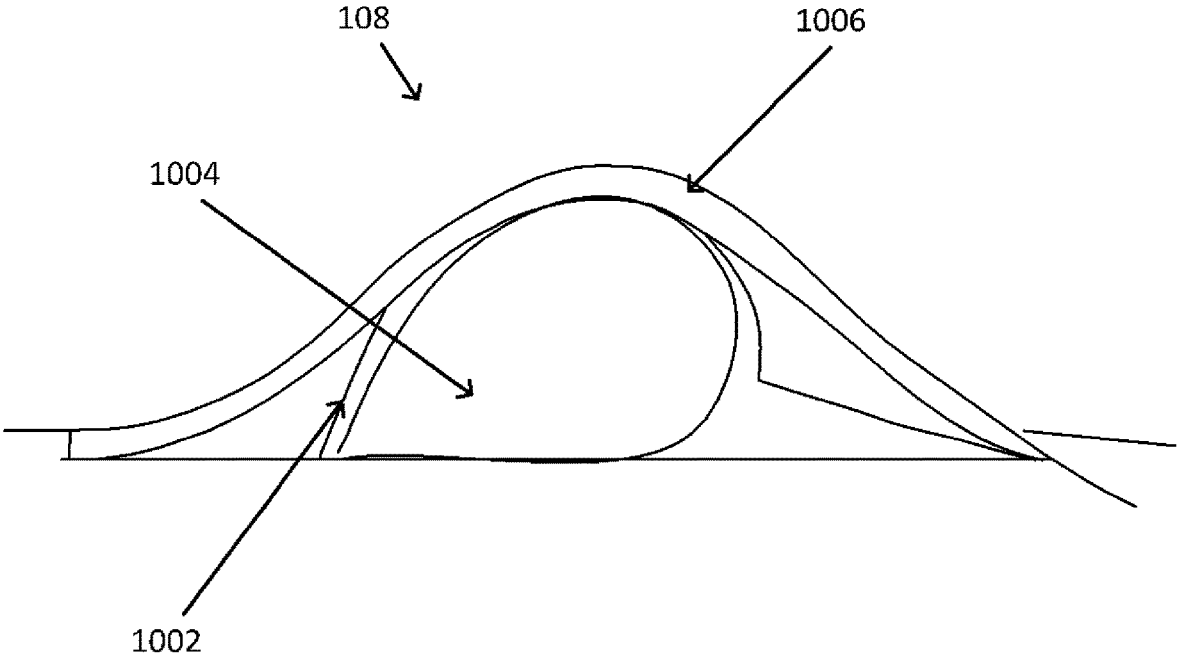
FIG. 10 illustrates a partial cross sectional view of components of an exemplary wave system according to embodiments described herein.

FIG. 10 illustrates an exemplary embodiment of an obstacle 108 according to embodiments described herein. As illustrated, the obstacle 108 includes an actuator for adjusting a profile, shape, orientation, height, angle of attack for inbound water, or a combination thereof. As illustrated, the actuator may be a bladder 1002 that is filled with a substance 1004 to inflate or change the contour, profile, shape, orientation, height, angle of attack, or any combination thereof. The bladder 1002 may be configured with one or more valves for permitting the substance to enter the bladder as well as vacate the bladder. The substance may be air, liquid, or solid.

As illustrated in FIG. 10, the obstacle may include a cover layer 1006. The cover layer may be used to provide a smoother transition for the passage of water over the obstacle than the actuator and/or other obstacle components without the layer would provide. The layer may be used to provide surface characteristics, such as a smoother, reduced frictional surface for passage of water thereover. In an exemplary embodiment, the cover layer may be configured such that a length of a surface encountered by flowing water from the front of the layer or obstacle to the back of the layer or obstacle can be changed as the obstacle is changed according to embodiments described herein. For example, the cover layer may extend into and out of a surface of the wave system as the bladder is deflated and inflated, respectively. The cover layer may be elastic or stretchable thereby providing the necessary deformation for expansion by the bladder. The cover layer may be overlapping or telescoping, pleated, or otherwise deformable to permit the desired actuation to change the obstacle as described herein. The obstacle may include one or more additional surfaces for providing increased rigidity and/or a desired surface to encounter the water. The surface may be planar, curved, complex curved, or a combination thereof.

Figure 11:
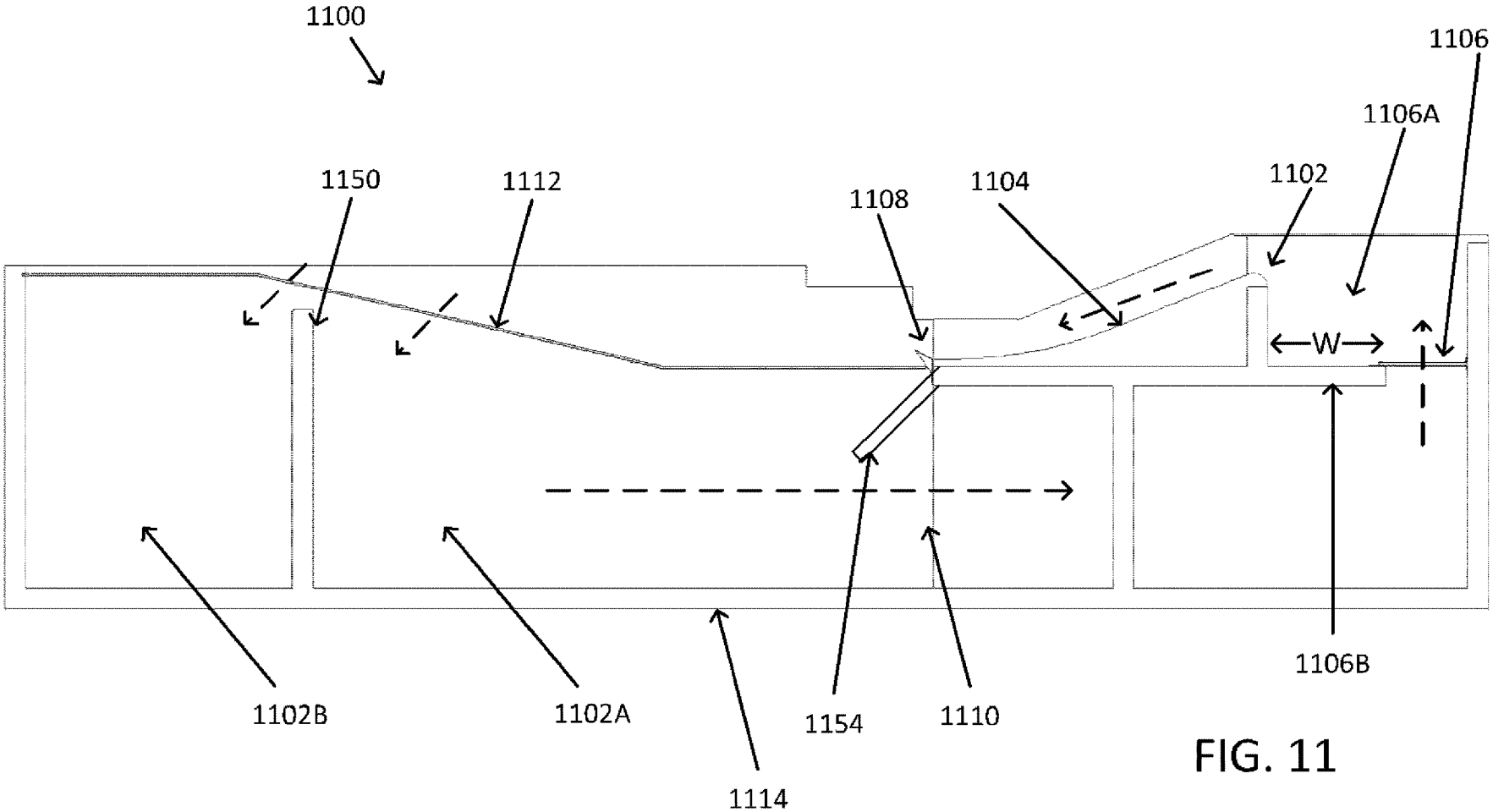
FIG. 11 illustrates an exemplary side cut away view of an exemplary wave system according to embodiments described herein.
Figure 12:
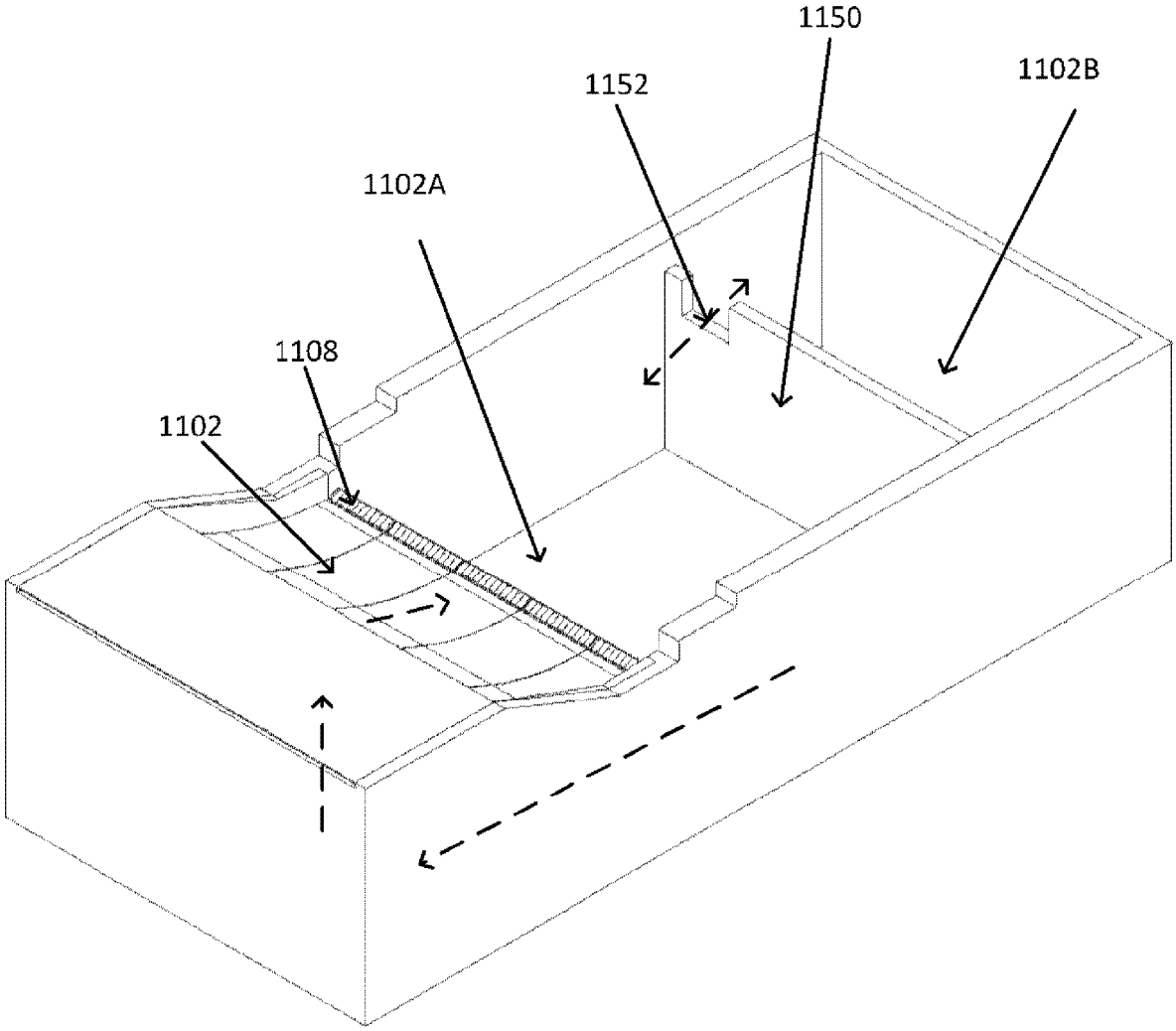
FIG. 12 illustrates an exemplary perspective view with the exterior surfaces removed for better disclosure of exemplary configurations according to embodiments described herein.

FIG. 12 illustrates an exemplary embodiment of an obstacle to create a wave by controlling the water level to form a hydraulic jump. FIG. 11 illustrates an exemplary embodiment in which the hydraulic jump and use of the water level can be used in combination with obstacle 1108 at the end of declined surface 1104.

In an exemplary embodiment, the obstacle may be formed through the manipulation of the water levels within the containment structure 1114. As seen in FIG. 12, the containment structure 1114 may comprise a separation wall 1150 for controlling a water level within the containment structure after the declined surface 1104. Specifically, a water height of the tail water may be adjusted. As illustrated, a first containment area 1102A and second containment area 1102B may be defined within containment structure 1114. Water may be pumped, and/or permitted to flow between the first containment area 1102A and second containment area 1102B in order to adjust the water height of the tail water. In an exemplary embodiment, the separation wall 1150, or a portion thereof, may be configured to adjust a height and thereby permit fluid flow between the first containment area 1102A and second containment area 1102B. For example, as illustrated in FIG. 12, a weir gate 1152 may be provided in separation wall 1150. The weir gate 1152 may be adjustable to permit fluid to flow from one side to the other of the separation wall 1150.

As illustrated in FIG. 11, the end of the declined surface 1104 may include an obstacle 1108. The obstacle 1108 may be attached at one end to the declined surface 1104, transition surface or other ride surface. The obstacle 1108 may have a free end or closed rear end that projects. The obstacle 1108 may include a front face that continues from the ride surface and extends upward in elevation from the lowest portion of the ride surface. In an exemplary embodiment, the obstacle 1108 may have an attached end to the ride surface and a free end extending upward and away from the ride surface. The attached end may be rigidly attached, such that it is not moveable relative to the ride surface. The attached end may be dynamically attached, such that it is moveable or positionable relative to the ride surface. For example, the attached end may be rotatable about an axis such that an angle of a surface of the obstacle is positionable at a desired angle between 0 degrees (horizontal) to 90 degrees (vertical).

As illustrated, the wave system 1100 may include a declined surface 1104. The declined surface 1104 may be positioned adjacent the water outlet 1102. Exemplary embodiments may have the water outlet 1102 at a higher elevation and the declined surface 1104 is configured to move the water to a lower elevation before encountering the obstacle 1108. The declined surface 1104 may be configured to increase the velocity of the water encountering the obstacle. The declined surface 1104 may be used to create a trough between the declined surface 1104 and the obstacle 1108 to influence the shape of the contoured wave surface created by the water. The wave system 1100 may also include a transition surface between the declined surface 1104 and the obstacle 1108. The wave system 1100 may include a water drainage system 1112 to remove the water from the ride area and/or permit rider exit. The wave system 1100 may also include a containment structure 1114 for holding and containing the water and wave system components, and nozzles 1110 (not shown in specific form) for moving the water through the containment structure 1114 to the water outlet 1102. Water flow through the exemplary system 1100 is illustrated by dashed arrow lines. As illustrated, the water is moved through the containment system, through water outlet 1102, down declined surface 1104, encounters the obstacle 1108, and is returned to the containment structure 1114 through drainage system 1112.

Exemplary embodiments may include a controller coupled to the actuator 422 for controlling a shape of the obstacle 108. The controller and actuator may be used in combination with any of the exemplary obstacles as described herein. For example, the actuator may be a lever arm for elevating, rotating, or otherwise repositioning one or more surfaces of the obstacle, and/or an inflatable bladder for rotating, elevating, or otherwise repositioning one or more surface of the obstacle. Changing a shape of the obstacle may include any combination of a change in a front profile of the obstacle, a height of the obstacle, a slope of one or more surfaces of the obstacle, a cross sectional profile of the obstacle, an orientation of the obstacle and/or any component part of the obstacle, etc. The controller may be configured to dynamically control a position and/or shape of the obstacle. The controller may permit a user to select a position and/or shape of the obstacle. The controller may permit a user to select a skill level, such as beginner, intermediate, and experienced. The controller may thereafter position the obstacle at a corresponding shape associated with the selection of the skill level. The controller may also include a programmer. The programmer may include a schedule that permits a user to select an obstacle shape at desired times, intervals, etc. The programmer may communicated with the actuator to adjust or change the obstacle shape according to the desired or entered schedule. The controller may also be configured to adjust the shape of the obstacle based on the operational time of the wave system. For example, during start up or shut down, the shape, such as the height, of the obstacle may be minimized. The reduction in the obstacle may permit the water to flow over the obstacle more easily and reduce the start-up water agitation. Once the water has run for a predetermined amount of time, the obstacle may be increased in size so that the contoured water surface may be created.

In exemplary embodiments, the wave system may also include a controller for adjusting an amount of water through the pumps. The controller of the pump may adjust a flow rate of the pump. The combination of either or both of the adjustments to the obstacle and/or the pump flow rates may be used to change the contoured wave surface of the water. The adjustment to the contoured wave surface of the water may be used to provide different ride experiences. The adjustment to the pump flow rate and/or obstacle shape may be used to create a contoured wave surface to correspond with an experience level of the user.

Referring back to FIG. 2, exemplary embodiments of the wave system 100 includes an obstacle 108 for creating a contoured wave surface with the water for riding or performing maneuvers by a user. Although described with respect to FIG. 2, exemplary embodiments of the nozzles and/or positioning thereto may be used in combination with any of the exemplary obstacles described herein. As described herein, the obstacle 108 may be positioned around a central area of the ride structure. In an exemplary embodiment, the nozzle 204 positioned below the ride area may be proximate to, in line with, or rearward (on a side opposing the water entry and toward the water drainage system) of the obstacle 108. Exemplary embodiments may include a removable water drainage portion. The wave system may therefore permit access to the reservoir 202 through all or a portion of the water drainage surface. By positioning the water pumps rearward of the obstacle, the pumps may be closer to, proximate to, or under a portion of the water drainage surface. The nozzles may therefore be easier to access for replacement, installation, and/or maintenance. As described herein, exemplary portions of the containment structure 114, and/or surfaces 104, 106, 110 may be concrete. Therefore, access under or through these surfaces may be difficult. Access through the removable pump system may therefore improve ease of access without weakening or compromising the structural infrastructure and/or complicating the infrastructure. However, access panels may also be provided in the wave system. For example, access panels may be provided through the ride surface and/or through exterior wall sin order to access areas that may include components parts, such as filters.

Figure 5:
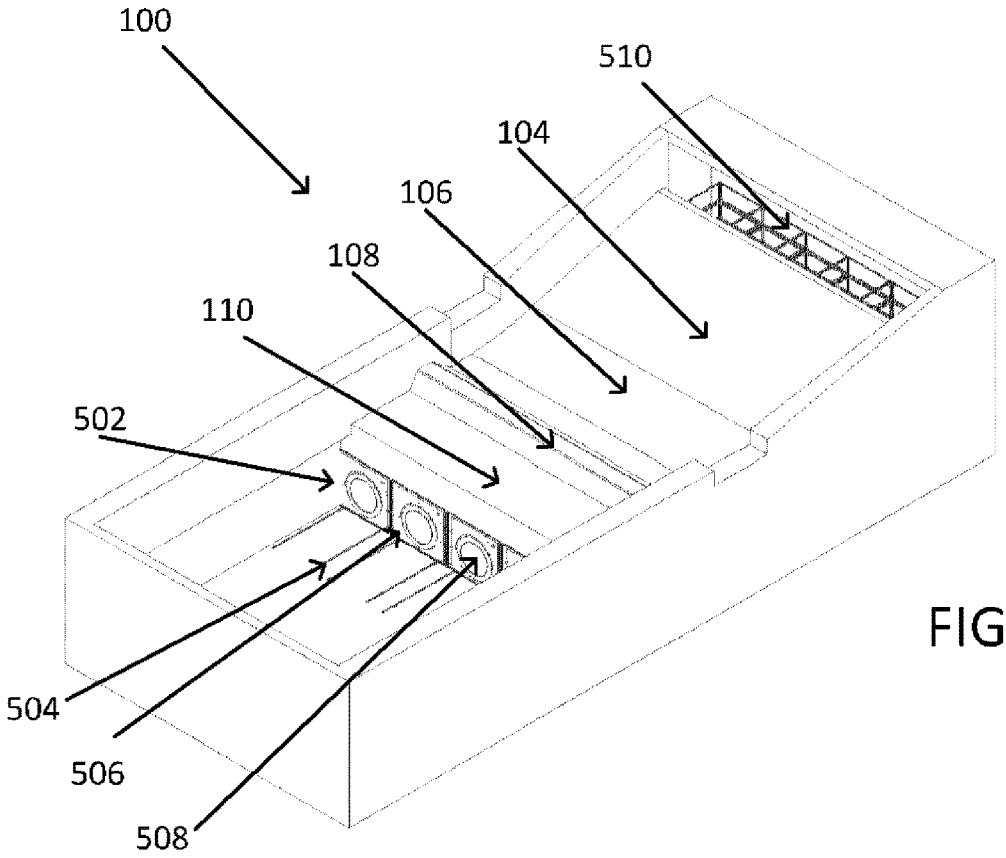
FIG. 5 illustrates a perspective view with component parts removed for visualization of an exemplary wave system according to embodiments described herein.
Figure 6:
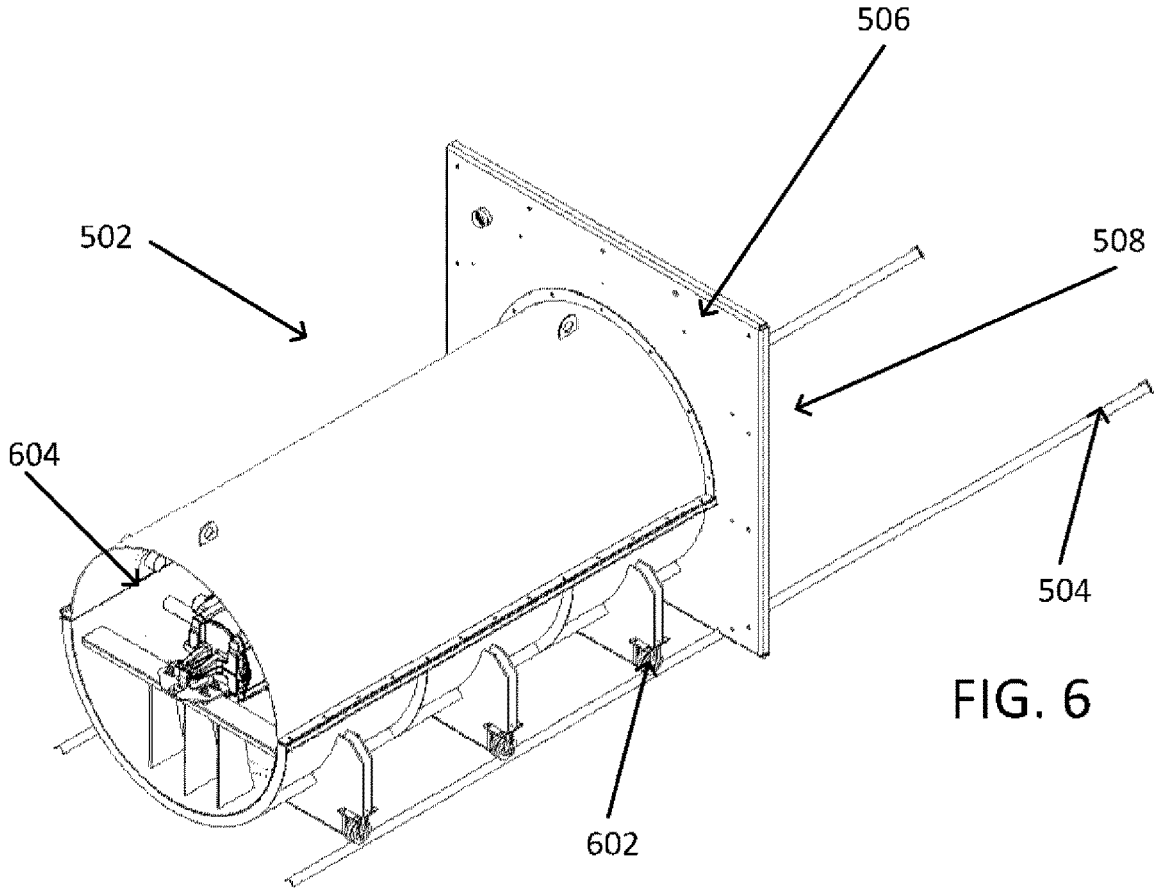
FIG. 6 illustrates a perspective partial component view for use with an exemplary wave system according to embodiments described herein.

FIG. 5 illustrates a perspective view of the wave system 100 with the water drainage system surface portion removed to permit viewing of the nozzles positioned thereunder. FIG. 6 illustrates a perspective view of an exemplary nozzle according to embodiments described herein for use in an exemplary wave system. As illustrated, a portion of the nozzles may extend rearward or be positioned proximate to the end of the concrete portion of the containment structure defining a portion of the ride area floor (surfaces 110 and/or 106).

As illustrated, in an exemplary embodiment, the pump system may include one or more pumps 502, a water inlet 508 and water outlet 604. The water inlet 508 may be configured to draw water from a lower portion of the reservoir. As illustrated, the water inlet 508 includes a front surface 506. The front surface 506 may be configured to attach or couple to the infrastructure of the wave system. The pump system 502 may be configured to draw water from the reservoir near the top, middle, bottom, or a combination thereof of the reservoir. In an exemplary embodiment, the system may be configured to draw toward the bottom of the reservoir. Water from the top surface of the water level within the reservoir may be aerated and/or may draw in air from above the surface of the water level. In some cases, if the water is pulling from the water surface into the water inlet 508 of the pump 502, the system may pull in air from the water surface. This may occur if a vortex from the water surface is created at the water inlet into the pump. When this air is pulled through the pump and ejected with the water onto the ride surface, it may cause cavitation. The pump may include components to reduce the cavitation of the system by limiting the air being pulled from a surface of the water. For example, the pump may include a lip (not shown) that extends over a top of the water inlet 508. The lip may reduce the water directly pulled from the surface and reduce a corresponding amount of air into the pump system. Other features may also be used to direct the water from lower in the water column. For example, tubes or other passages may be used to direct water from a desired location within the water column. These components and features may be selected based on the water level and the clearance of the system above the ground of the reservoir. The wave system may also include an intermediate layer between the water drainage system and the reservoir that may reduce the aeration of the water before it enters the pumps. Such layers may include surface structures at the top of the reservoir, or other intermediate structure to reduce the impact of the water returning from the ride surface to the reservoir to reduce the churning and/or incorporation of air into the water within the water column of the reservoir before the water enters the pump(s).

As illustrated, the pumps 502 may be moveable relative to the containment structure. In an exemplary embodiment, the relative movement may be achieved or facilitated through the use of a movement system. In an exemplary embodiment, the relative movement may be achieved through the use of rollers 602 and/or tracks 504. As illustrated, the pumps 502 may include a plurality of rollers 602 to support the pumps. The rollers 602 may be positioned on corresponding tracks 504 to control the relative position and movement of the rollers. Although rollers on tracks are illustrated as an exemplary movement system, other system may be used, such as telescoping rails, sliders, or other systems for linear translation of component parts. Although linear translation is shown and describe, and specifically a single axis translation along rails, the invention is not so limited. Other systems may be used. For example, a two-axis linear translation system like a gantry system may be used. Other configurations may permit translation in a first direction then followed by translation in a second direction. This configuration may permit the pumps to act like an access panel, pulling them out and then over to permit an opening under the ride surface area. Other configurations and movement platforms are also considered herein.

Figure 7A:
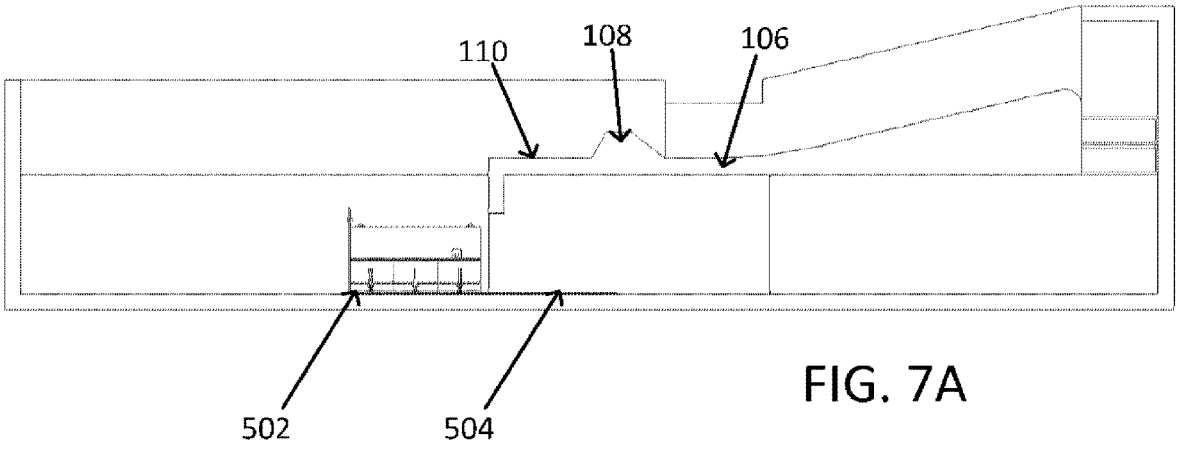
FIGS. 7A-7B illustrate a cross sectional view of components of an exemplary wave system in a first and second position according to embodiments described herein.
Figure 7B:
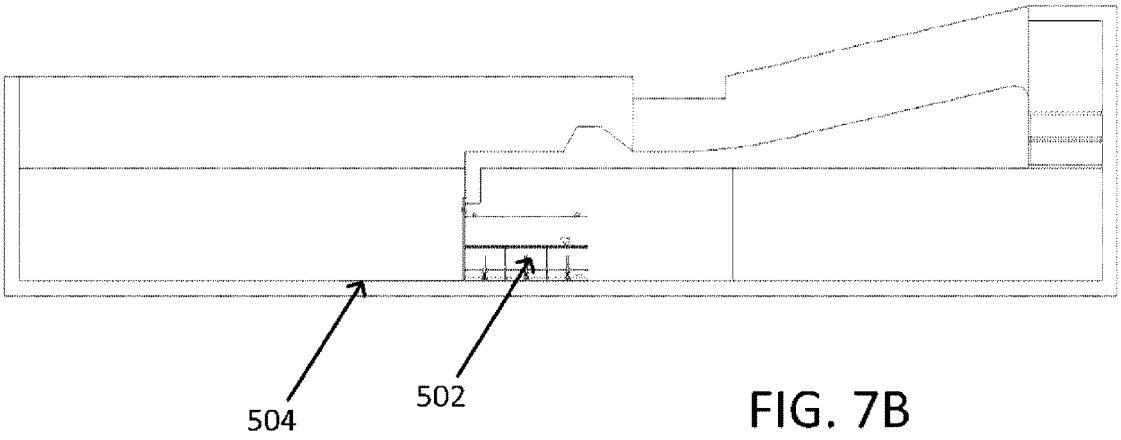

Exemplary embodiments of the wave system 100 according to embodiments described herein may include a pump system having a first position and a second position. FIGS. 7A-7B illustrate a cross sectional view of the wave system in which the pumps are in a first and second position. FIGS. 8A-8B illustrate a top elevation view of the wave system with the water drainage portion removed to permit viewing of the pumps in the first and second position, as described herein. In an exemplary embodiment, the first position of the pump (as seen in FIGS. 7B and 8B) may be an in use position. The pump 502 may be positioned in a forward position toward the water outlet 102. In an exemplary embodiment, the forward position may be with a portion or all of the pump positioned under or proximate a portion of the containment structure or ride structure, such as surface 110, surface 106, obstacle 108, or combinations thereof. The pumps may be secured into the first position such as by lock on movement system, bolting or other attachment of the pump structure to the infrastructure, such as portions of the containment structure 112, or combinations thereof. The second position of the pump (as seen in FIGS. 7A and 8A) may be in an exposed configuration. The second position may be rearward (away from the water outlet 102) than the first position. The second position may exposed a portion or all of the pump structure. The second position may therefore improve efficiencies for repair, replacement, installation, and combinations thereof.

Figure 9:
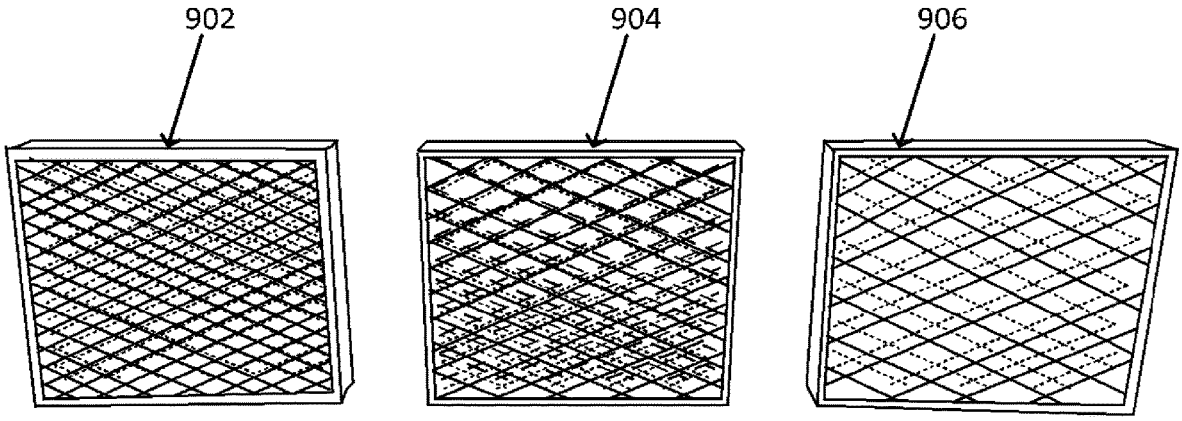
FIG. 9 illustrates exemplary water smootheners according to embodiments described herein.

Referring back to FIG. 2-3 or 5, exemplary embodiments of a wave system described herein may include a water smoothener 206, 306, 510. FIG. 9 illustrates exemplary components of a water smoothener according to embodiments described herein. Exemplary embodiments of a water smoothener include a plurality of sheets having apertures therethrough. Adjacent sheets of the plurality of sheets may be separated by a gap. The plurality of sheets may therefore define parallel planes that have a separation gap there between. Exemplary embodiments may have the same or different separation gaps between different adjacent sheets. In an exemplary embodiment, different sets of sheets may be coupled together. For example, a first set of sheets 902 may be coupled together, a second set of sheets 904 may be coupled together and a third set of sheets 906 may be coupled together. Different sets of sheets may thereafter be stacked to create a water smoothener. As illustrated, the aperture size, configuration, position, shape, orientation, and combinations thereof may be different between two or more sheets or set of sheets. In an exemplary embodiment, different aperture sizes, orientations, shapes, or other configuration is used between two or more sheets. Further, although a particular aperture size, configuration, position, shape, etc., is shown in connection with the first 902, second 904, and third 906 sets of sheets, it should be understood that these particular designs are not require, nor are they required in this particular order. With the variability between sheets, the apertures and structure defining the apertures will overlap between the different sheets. The overlap between the different sheets may therefore create a small mesh size or overall aperture size so that the water has a higher probability of contacting a sheet structure as it traverses from one end of the smoothener to another. The sheets may be crated from expanded metal. Metals sheets may have slits cut therein. The metal is then expanded to create the different aperture size and shapes. FIG. 2 illustrates an exemplary embodiment in which three sets of panels are used having different configurations, while FIG. 3 illustrates 2 sets of panels are used, in which each panel includes a plurality of sheets having apertures there in.

Other configurations to provide a smoother wave are also contemplated herein. For example, water smoothener 1106 may comprise a compartment for settling water before flowing from the water outlet 1102. As illustrated, the containment structure 1114 may create a lower area for containing water and circulating the water from the return water area after the obstacle 1108 and through water drainage system 1112 created by the permeable surface, under the declined surface 1104 and back to the water outlet 1102. The lower area may include the nozzles 1110 for moving the water in the desired water cycle. The water smoothener 1106 may include a separation wall 1106B to create a water compartment 1106A in which the water may rest before overflowing onto the ride surface from the water outlet 1102. As illustrated, the transition between the water compartment 1106A and the ride surface may be contoured to reduce the turbulence created as the water flows from the compartment to the ride surface. The water compartment 1106A may include an opening in the bottom of the compartment to permit water from the reservoir defined by the containment structure 1114 to fill the water compartment 1106A. The floor of the water compartment may be partially defined by a separation wall 1106B between the water compartment and the water reservoir. In an exemplary embodiment, the width of the water compartment and/or the separation wall 1106B (W) is at least 8 feet. The opening between the water smoothener 1106 and the water reservoir to permit fluid flow therebetween may include additional components, such as additional smootheners, filters, valves, deflectors, flow controls, or a combination thereof.

In an exemplary embodiment, additional flow control components may be incorporated into the wave system described herein. For example, referring to FIG. 11, a protection surface 1154 may be used near the inlet or before the inlet of the nozzles. The protection surface 1154 may extend from the surface, above the surface, or near the surface of the water downward into the reservoir. The protection surface may be positioned over or before the nozzles. Such that the protecting surface may limit the water entering the nozzles from the top of the reservoir, and instead flow water from the lower portion of the reservoir through the nozzles.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Specifically, any combination of the nozzles, water smoothener, recirculation, obstacle, wave formation configurations, controllers, actuators, etc. may be used in any combination and remain within the scope of the instant disclosure. Embodiments are exemplary only, and provide an illustrative combination of features, but are not limited thereto.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A wave system, comprising:

a water outlet for introducing water onto a ride surface in a water flow path;

an obstacle in the water flow path on the ride surface, wherein the obstacle is moveable relative to the ride surface and is configured to generate a contour on a surface of the water flowing over the obstacle;

a reservoir below the ride surface comprising a first water containment area and a second water containment area adjacent to the first water containment area and separated by a substantially vertical separation wall; and a water recovery for removing water from the ride surface;

wherein a height of the water on the ride surface may be controlled by adjusting the amount of the water in the first and second containment areas after the water passes over the obstacle.

2. The wave system of claim 1, further comprising one or more pumps within the reservoir for moving water to the water outlet.

3. The wave system of claim 1, further comprising a water smoothener adjacent to the reservoir.

4. The wave system of claim 3, wherein the water smoothener is positioned between an outlet of the one or more pumps and the water outlet.

5. The wave system of claim 3, wherein the water smoothener comprises a water compartment over the reservoir at least partially separated from the reservoir by a second separation wall, and wherein the water smoothener and the reservoir are in fluid communication through an opening in the floor of the water smoothener.

6. The wave system of claim 1, wherein the first water containment area and the second water containment area are in fluid communication through a weir gate.

7. The wave system of claim 1, wherein the obstacle comprises a surface extending from the ride surface upward and away from the ride surface.

8. The wave system of claim 1, wherein the obstacle comprises a first end attached to the ride surface and a second end not attached to the ride surface.

9. The wave system of claim 1, further comprising a protection surface positioned in the reservoir adjacent one or more nozzles such that water entering the nozzles is from a lower portion of the reservoir.

10. The wave system of claim 1, wherein:

the ride surface includes a declined surface;

the obstacle is arranged at an end of the declined surface; and water flows into the first containment area after passing over the obstacle.

11. The wave system of claim 10, wherein the second water containment area is arranged adjacent to the first water containment area, distal to the obstacle.

12. The wave system of claim 11, wherein the first water containment area extends underneath the obstacle.

13. The wave system of claim 6, wherein the weir gate is arranged at a top end of the substantially vertical separation wall.

* * * * *